United States Patent [19]

Bergstrom et al.

[11] 4,192,708

[45] Mar. 11, 1980

[54] METHOD FOR CONTROLLING THE ADDITION OF ACTIVE CHEMICAL FOR DELIGNIFYING AND/OR BLEACHING CELLULOSE PULP SUSPENDED IN A LIQUOR CONTAINING CHEMICALS REACTIVE WITH THE DELIGNIFYING AND/OR BLEACHING CHEMICAL

[75] Inventors: John R. Bergstrom; Bengt G. Hultman, both of Domsjoverken; Astrid T. P. Dalborg, Bonassund, all of Sweden

[73] Assignee: Mo och Domsjo Aktiebolag, Ornskoldsvik, Sweden

[21] Appl. No.: 767,174

[22] Filed: Feb. 9, 1977

Related U.S. Application Data

[63] Continuation of Ser. No. 608,310, Aug. 27, 1975, abandoned.

[30] Foreign Application Priority Data

Sep. 5, 1974 [SE] Sweden ..... 7411247

[51] Int. Cl.[2] ..... D21C 9/10; G01N 31/16; G01N 33/00

[52] U.S. Cl. ..... 162/49; 23/230 A; 162/80; 162/DIG. 10

[58] Field of Search ..... 162/49, 17, 238, DIG. 10, 162/66, 67, 87, 90, 88, 89; 23/230 A

[56] References Cited

U.S. PATENT DOCUMENTS

| | | | |
|---|---|---|---|
| 2,783,135 | 2/1957 | Locchbrandt | 23/230 A |
| 3,764,463 | 10/1973 | Histed et al. | 162/238 X |
| 3,888,726 | 6/1975 | Haltman | 162/238 X |
| 3,980,517 | 9/1976 | MacTaggart | 162/49 |
| 4,013,506 | 3/1977 | Histed et al. | 162/49 |

OTHER PUBLICATIONS

Casey; *Pulp & Paper* vol. I, Second Ed. Interscience Publishers, Inc., New York, 1960, pp. 456–457.

Burnett "Computer Control of the Chlorine Stage" *Pulp and Paper Magazine of Canada;* vol. 71, No. 14.

*Primary Examiner*—S. Leon Bashore

*Assistant Examiner*—Steve Alvo

[57] ABSTRACT

A method is provided for controlling the addition of active chemical for delignifying and/or bleaching cellulose pulp suspended in an aqueous liquor containing at least one chemical reactive with such active chemical, which comprises determining the amount of active chemical consumed by the chemical reactive with the active chemical in the liquor; adding the active chemical to the cellulose pulp suspension; and then after a predetermined time interval determining the amount of active chemical consumed by the chemical and cellulose pulp reactive with the active chemical in the liquor; from these determinations determining the amount of active chemical consumed by the pulp; and then carrying out the delignification and/or bleaching with an amount of active chemical adjusted according to the amount of active chemical consumed by the pulp.

34 Claims, 4 Drawing Figures mV 2,0
1,50
1,0
0,50
0,20
0,40
0,60
0,80
1,00
Cl2 g/l mV 0,40
0,20
0,10
0,05
0,10
0,15
0,20
Cl2 g/l

Figure 1:
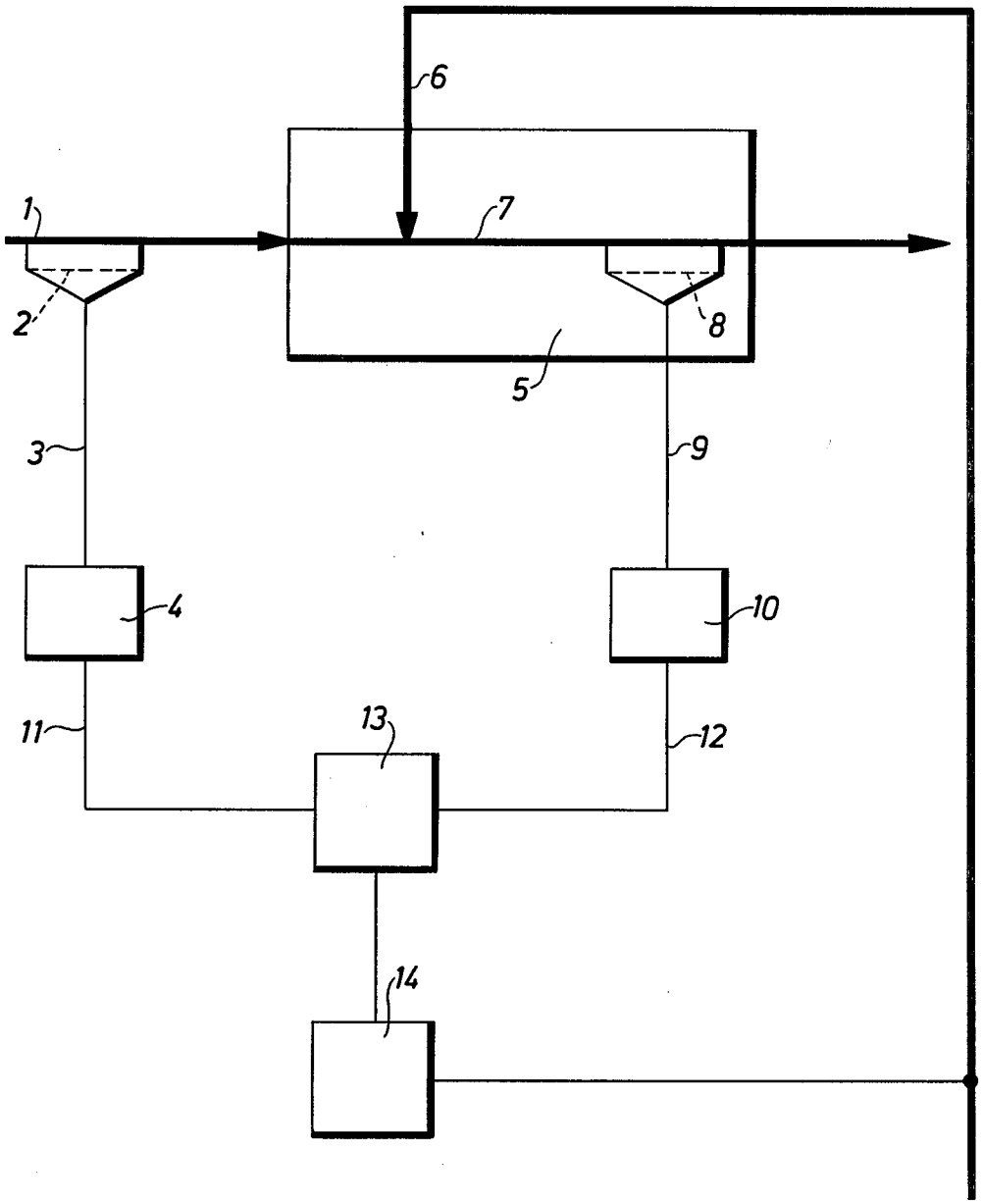

METHOD FOR CONTROLLING THE ADDITION OF ACTIVE CHEMICAL FOR DELIGNIFYING AND/OR BLEACHING CELLULOSE PULP SUSPENDED IN A LIQUOR CONTAINING CHEMICALS REACTIVE WITH THE DELIGNIFYING AND/OR BLEACHING CHEMICAL

This is a continuation, of application Ser. No. 608,310 filed Aug. 27, 1975 and now abandoned.

Cellulose pulp is usually bleached in order to remove "residual lignin" from the pulp, i.e. lignin which may not have been dissolved out during the first delignification treatment stages carried out during digestion of the raw lignocellulosic material in accordance with sulphite, sulphate, oxygen-gas and alkali, or other cooking methods. Since residual lignin is dissolved, the bleaching can be referred to as a delignification stage. Bleaching also is carried out in order to increase the brightness of the pulp. In pulp beaching processes carried out on a commercial scale, the pulp is treated stepwise with one or more active chemicals for delignifying and/or bleaching cellulose pulp, including chlorine, chlorine dioxide, hypochlorite, sodium hydroxide, hydrogen peroxide, dithionite, sulphite, and, more recently, oxygen gas and alkali.

The cost of the active chemicals required for bleaching and/or delignification is very high, and constitutes an important proportion of the cost of the manufacture of bleached cellulose pulp. A sufficient amount of active chemical must be used, but not too much, since the quality of the end product is affected by the quantity of bleaching chemicals supplied. Consequently, it is important that the correct quantity of active chemicals be charged to the system. However, the correct amount is not easy to determine, because the residual lignin content of the cellulosic material varies, and so does the amount of chemicals required. The relatively long bleaching times required for effective bleaching and for delignification also increases the difficulty of control. The measures taken to protect the environment against harmful and contaminating discharges have increased the retention of impurities and washing residues in the liquor in which the pulp is transported to the bleaching section. Variations in the extent to which the lignocellulosic material is washed and digested are reflected in variations in the total lignin in the pulp transported for bleaching, and in the distribution of the lignin dissolved in the suspending liquor and lignin bound to the cellulose fibers. In addition to dissolved lignin, the liquor also contains chemicals such as sulphide, thiosulphate and organic sulphur compounds that are reactive with the active chemicals used for bleaching and/or delignification, and that also consume such active chemicals. The amount of delignifying and/or bleaching chemicals that react with such substances and with the lignin bound to the cellulose fibers is of course lost for bleaching and/or delignification, and this is reflected in an incomplete delignification and/or bleaching, or worse. It is therefore necessary to take this into account in determining the amount of active chemicals added. The art has accordingly utilized one of the following alternatives:

(a) The addition of active chemicals to the pulp suspension is based on the content of residual chemicals in the pulp suspension, determined subsequent to the bleaching. The amount of residual chemicals, e.g. active chlorine compounds dissolved in the residual bleaching liquid, is determined manually, at predetermined time intervals. Owing to the variations in the properties of the pulp suspension, and the relatively long residence time of the pulp in the bleaching section, it is necessary to charge the bleaching chemicals to the system in a slight excess, in order to ensure a satisfactory bleaching, which has a negative effect on the quality of the pulp, and increases bleaching cost unnecessarily.

(b) The addition of active chemicals to the pulp suspension is based on the content of residual chemicals in the pulp suspension determined shortly after the bleaching process has begun. The addition of active chemicals is so made that the measurement value by the analytic method being used is maintained constant at the point at which the measurement is taken (so-called set-point control). The measurement value can be, for example, a redox potential, a polarographic analysis value, or a signal obtained by optical means. The desired set-point value can be adjusted as desired on the basis of manually effected residual-chemical analyses. In this method, the amount of active chemicals added to the system can be changed more rapidly than in the method described under (a), but the method is deficient, inasmuch as it assumes the measurement value reflects the amount of active chemicals consumed by the pulp, but it actually does not. The measurement value is in fact inaccurate to the extent that the active chemicals are also consumed by nonpulp substances reactive therewith and dissolved in the liquid phase of the pulp suspension.

(c) The amount of active chemicals added to the pulp suspension is changed in accordance with set-point values in the manner described in (b) above, but in this case the set-point value is changed, as required, on the basis of values obtained from an automatic analysis of the residual-chemical content after the termination of the bleaching reaction. This is a combination of (a) and (b), but although the result obtained hereby is an improvement on these alternatives taken alone, the method does not eliminate all the disadvantages encountered with the method (b) above. Furthermore, because of the relatively long residence time of the pulp in the bleaching tower, only relatively slow variations in the amount of chemicals required to be charged to the system can be compensated for by changing the metering of chemicals.

None of these methods takes into account the fact that the amount of active chemicals consumed is not solely dependent upon the lignin content of the cellulose pulp, but also is dependent on dissolved lignin, i.e. the washing losses which have not been recovered and passed to an evaporation and combustion section, together with inorganic compounds that consume active chemicals, such as chlorine.

In accordance with the invention, a process is provided for controlling the addition of active chemical for delignifying and/or bleaching cellulose pulp suspended in an aqueous liquor containing at least one chemical reactive with such active chemical, which comprises determining the amount of active chemical consumed by the chemical reactive with the active chemical in the liquor; adding the active chemical to the cellulose pulp suspension; and then after a predetermined time interval determining the amount of active chemical consumed by the chemical and cellulose pulp reactive with the active chemical in the liquor; from this determination determining the amount of active chemical consumed by the pulp; and then carrying out the delignification and/or bleaching with an amount of active chemical adjusted according to the amount of active chemical consumed by the pulp.

Two analyses are necessary for this determination, one taken before and one after the addition of the active chemical to the pulp suspension.

An important feature of the method according to the invention is that the amount of active chemical is determined a predetermined time interval after the active chemical has been charged to the liquor. This time interval can be rather short and is within the range from about 30 seconds to about ten hours. Since a certain quantity of the chemical is immediately consumed, sampling of the suspending pulp liquor for the purpose of obtaining this measurement value can be effected immediately, i.e. within a few seconds, after charging the active chemical to the liquor. It is advantageous to take the measurement after a predetermined time interval during the actual bleaching stage, when it is observed that the bleaching and/or delignification reaction is taking place. Thus, the analytical determination can be effected at the beginning of the bleaching and/or delignification stage, or during the stage. The determination can also be made at the end of the stage, particularly if the reaction time in the bleaching stage is shorter than half an hour. It is particularly convenient to take the sample during the initial stages, i.e. within the first ½ hour of the bleaching and/or delignification stage, preferably within the first twenty minutes, in order to obtain the correct value as quickly as possible, and thus control the addition of active chemical to the pulp suspension at the start. However, when the active chemical is not completely consumed during the bleaching and/or delignification stage, a determination can be made of the quantity of residual, unconsumed active chemical at the end of the stage.

By "bleaching and/or delignification stage" is meant a bleaching or delignification process in which one or more bleaching and/or delignifying chemicals is supplied to the pulp, and permitted to react therewith, resulting in consumption of bleaching and/or delignification chemicals. Another form of process to which the invention can be applied is a lignin extraction stage, in a pulp bleaching process, in which stage the pulp is treated with an alkaline solution to dissolve lignin from the pulp. In this instance, in accordance with the invention, there is taken a first sample to determine the alkali requirement of the pulp-suspending liquor for the lignin extraction, and a second sample, subsequent to the alkali addition, to determine the amount of alkali consumed by the pulp, after which the measurement values are used to control the quantity of alkali introduced to the system.

The method according to the invention makes it possible to control the delignification in a way to equalize variations in the lignin content of the treated pulp.

The method according to the invention is particularly suited for use with lignocellulosic material such as wood which has been digested by means of chemical processes, such as sulphite, sulphate, oxygen gas/alkali, bisulphite, and soda cooking processes. The method can also be applied to pulps obtained by semichemical, mechanical, and thermomechanical processes. The method according to the invention is particularly suitable for use with chemical pulps having a lignin content corresponding to a Kappa number within the range from about 100 to about 5, suitably from about 40 to about 9 and preferably from about 35 to about 10, the method being preferably applied in an introductory bleaching stage, wherein in addition to obtaining an improved brightness, a continued delignification of the pulp is also obtained. When the method of the invention is applied in conjunction with the manufacture of semichemical, mechanical, and thermomechanical pulps. so-called high-yield pulps, the brightness-improving reaction is more pronounced than the delignifying effect.

The method according to the invention can also be applied to any multistage bleaching and/or delignification processes, for example a bleaching stage, in which different bleaching chemicals, such as chlorine and chlorine dioxide, are used in sequential phases in the same treatment stage, without intermediate alkaline extraction or washing processes. The method according to the invention can also be applied while simultaneously using a plurality of active chemicals, for example, bleaching stages in which mixtures of chlorine and chlorine dioxide are used as the bleaching agents.

FIG. 1 represents a flow sheet showing application of the invention to a bleaching and/or delignification stage in a pulp manufacturing plant using for example chlorine as the active chemical.

Figure 2A:
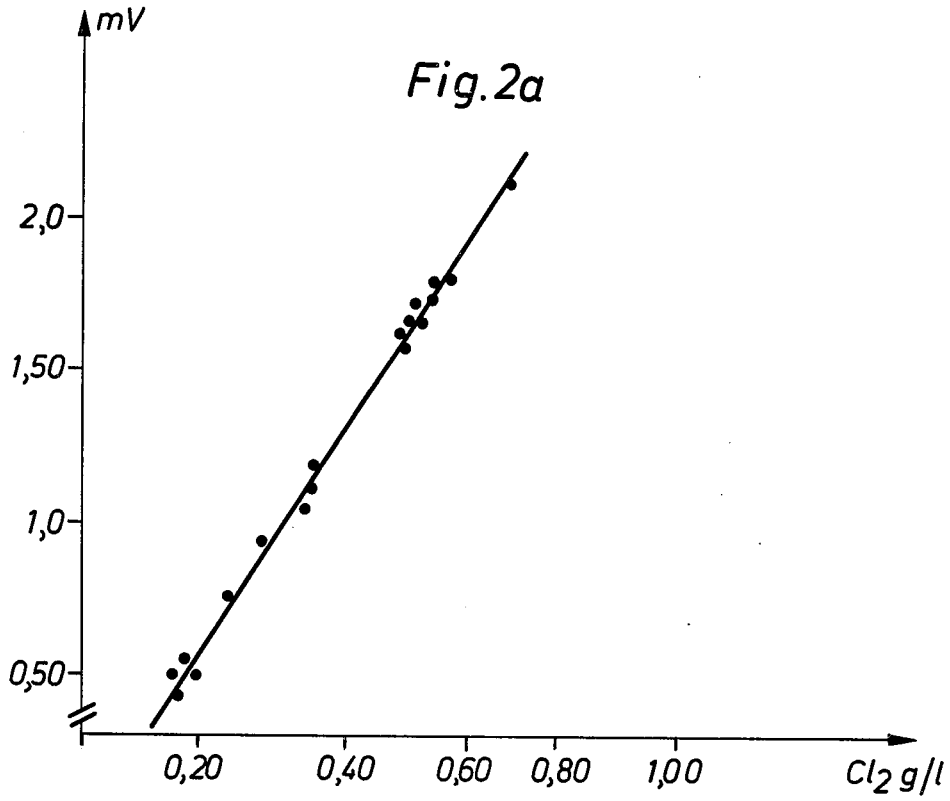

FIG. 2*a* is a graph showing the calorimetrically measured potentials in millivolts plotted against titrimetric chlorine consumption in the analysis of a sulphate pulp-suspending liquor of Example 1.

Figure 2B:
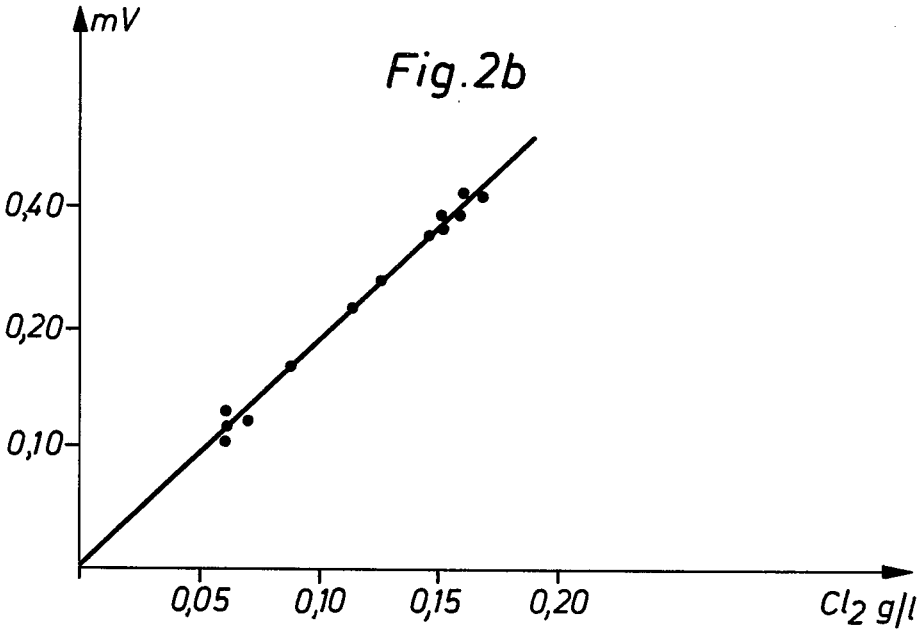

FIG. 2*b* is a graph showing the calorimetrically measured potentials in millivolts plotted against titrimetric chlorine consumption in the analysis of a sulphite pulp-suspending liquor of Example 1.

Figure 3:
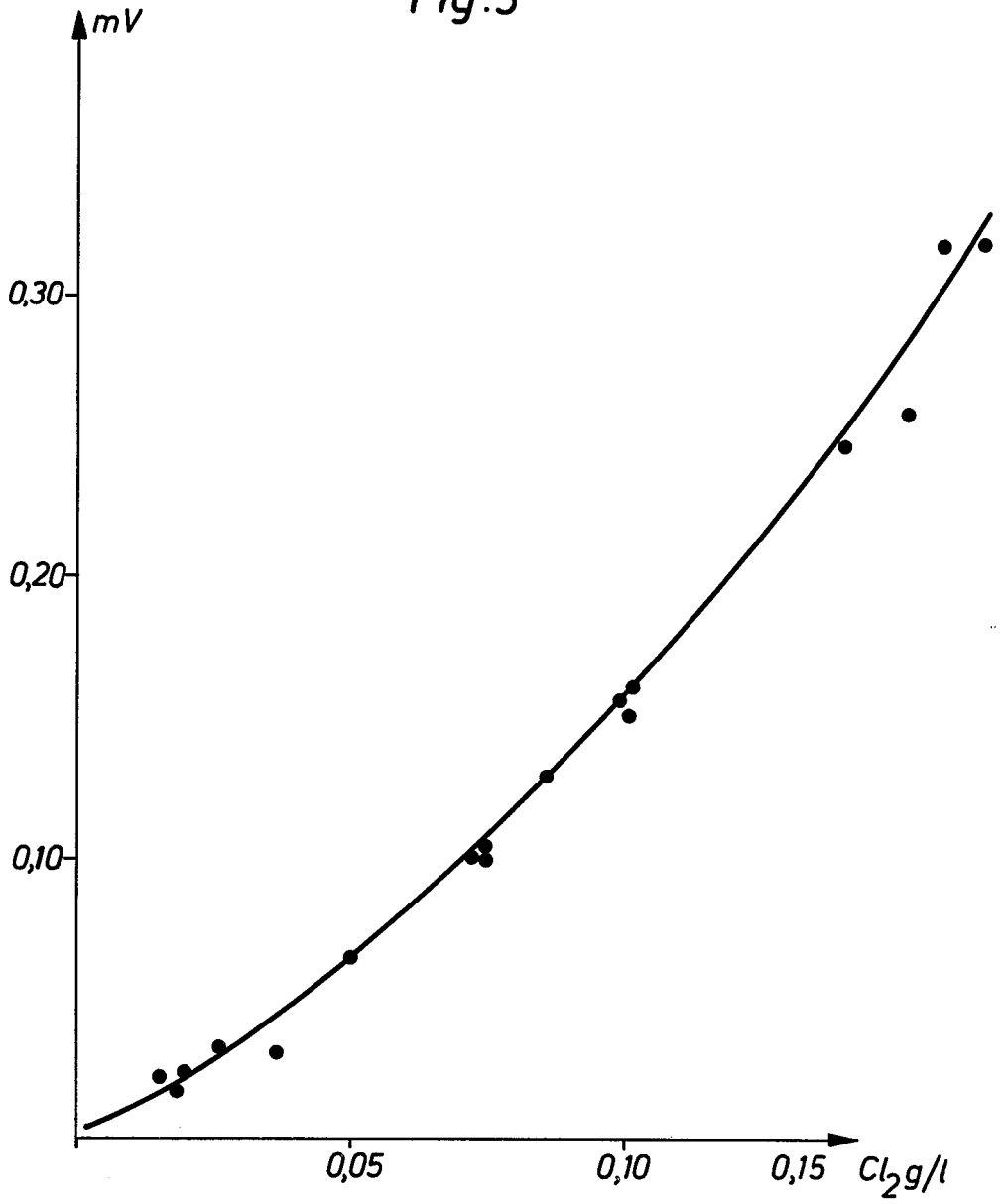

FIG. 3 is a graph showing the calormietrically measured potentials in millivolts plotted against titrimetric chlorine consumption in the analysis of a sulphite pulp-suspending liquor of Example 2.

In the process shown in FIG. 1, a pulp suspension 1, arriving from a cooking-screening stage from a sulphate, sulphite, oxygen/alkali or other pulp manufacturing processes cr from an earlier bleaching and/or delignification stage, was passed to a sampler 2 in which the liquor sample stream 3 was taken from the pulp suspension and filtered to remove pulp fibers. The sample stream 3 was passed to an analyzer 4, in which the amount of chlorine consumed by the liquor was determined. The pulp suspension was mixed with a stream of chlorine 6 in a bleaching stage 5. After the chlorine had been added to the pulp suspension, the suspension was permitted to react with the chlorine for, for example, twenty minutes, and was then passed to the next bleaching stage. After this time interval after the addition of chlorine, the pulp suspension was passed to a second sampler 8 in which the liquid sample 9 was taken from the pulp suspension and filtered to remove pulp fibers. The time at which the second sample is taken may vary, however, between a few seconds after the chlorine has been mixed with the pulp suspension, to the end of the stage, when the suspension leaves the bleaching stage 5.

The sample stream 9 was passed to an analyzer 10, in which the quantity of residual chlorine in the liquid is determined. On the basis of the results obtained in the analyzers 4 and 10, it is possible to calculate the quantity of chlorine consumed by lignin bound to the cellulose in the pulp fibers, and the amount of chlorine consumed by chlorine-reactive substances in the suspending liquor. These calculations may be made electronically, in the computer 13, to which the measuring results are transmitted electrically via lines 11 and 12. On the basis of the results calculated by the computer 13, the flow of chlorine 6 to the bleaching stage 5 is regulated by regulating means 14.

In addition to controlling the flow of chlorine in the bleaching stage 5 by means of the signals obtained from the analyzers 4 and 10, the signals from the computer 13 may also be used to control the addition of bleaching agents to subsequent stages. By making two analyses, one prior to the addition of bleaching chemicals and one during the bleaching stage, it is possible to calculate the amount of bleaching agent actually required by the pulp, prior to passing said pulp to the bleaching stage. Thus, there is obtained a lignin-flow analyzer or a Kappa number analyzer, which effects a measurement on the whole of the pulp flow passed to the bleaching stage, and provides continuous measuring values.

This represents a great advantage over samples which are taken manually. The bleaching chemicals are dispensed to the pulp suspension in accordance with the Kappa number or the chlorine number of the input pulp, the number being a measurement of the lignin content, and related to active chemical consumption. The method according to the invention enables for the first time an analysis of the lignin flow to be made continuously, accurately and directly on the flow of material with which it is desired to control the amount of bleaching agent charged thereto. Another important advantage obtained with the method according to the invention is that the analysis made prior to the bleaching stage illustrates the efficiency of the waste pulping liquor recovery system. In addition hereto it is possible to take into account the amount of bleaching chemicals consumed by substances dissolved in the suspending liquor at exactly the right moment, since the sample for this analysis is taken before bleaching chemicals are added to the pulp suspension.

The analysis of the amount of bleaching chemicals consumed by the suspending liquor can be carried out in a number of ways, which are known and form no part of the instant invention.

One convenient method is to supply bleaching chemicals to a sample of suspending liquor in a known quantity, and in an excess quantity, e.g. in the form of chlorine water, and then, after a predetermined time interval, determine the excess of bleaching chemical in known matter, for example be iodine titration, polarographic measurement, measurement of the redox potential, measurement of the conductivity or pH, photometry, coulometry, or the like. It is particularly convenient, however, to permit the flow 3 to react with an excess of bleaching agent, and to determine the amount of heat developed thereby. This method is designated the calorimetric method. The calorimetric determination may also be effect with a reagent other than chlorine water, for example hypochlorous acid, hypochlorite, chlorine dioxide or hydrogen peroxide. Despite the fact that the substances dissolved in the suspending liquor comprise a mixture of a large number of mainly unknown substances, it has surprisingly been found that the heat developed during the calorimetric determination can be accepted as a reproducible measurement of the amount of bleaching agent consumed by the suspending liquor.

Analysis of the content of bleaching agent in the pulp suspension subsequent to addition of bleaching agent thereto and subsequent to the commencement of the bleaching reactions can be carried out in a number of ways. The most common methods include redox potential measurement, polarographic measurement, measurement of the conductivity or pH of the sample, and manual or automatic iodine titration on the content of residual active bleaching agent. It is desirable that the analysis be effected continuously, and that it be specific for the bleaching agent to be analyzed.

It has been found particularly advantageous to take a fiber-free sample of the suspending liquor 9, and to react the liquor with a suitable reagent, and to use the heat developed thereby as a reproducible measurement of the residual content of bleaching agent. By the selection of a suitable reagent, an analysis can be made in this way, for example on sodium hydroxide, hypochlorite, chlorine, chlorine dioxide and hydrogen peroxide. With certain bleaching processes, mixtures of bleaching agents are used, and, for example, chlorine and chlorine dioxide can be used in mixture. By the selection of a suitable reagent, it is possible to determine calorimetrically the total amount of active chlorine, or to determine the chlorine content and the chlorine dioxide content separately. Thus, according to the invention it is also possible to obtain specific information on how the content of one of the bleaching chemicals changes during the reaction sequence.

The invention is exemplified by the following Examples, in which Example 1 illustrates the analytical process for determining the chlorine consumption of the suspending liquor, Example 2 illustrates how to content of residual chlorine is determined after a predetermined time interval, and Example 3 illustrates the manner in which the flow of chlorine to an introductory chlorine stage is controlled. Example 4 illustrates the manner in which a chemical addition comprising the sequential addition of chlorine and chlorine dioxide is controlled. Example 5 illustrates the control of an alkaline charge to an alkaline delignification or lignin extraction stage, in a bleaching sequence.

EXAMPLE 1

The determination of the chlorine consumption of liquor from a pulp suspension.

From the pump suspensions in sulphite and in sulphate pulping liquors entering a first bleaching stage as at 1 in FIG. 1 were taken a large number of samples 3 of FIG. 1 of the liquor (liquor only; the pulp fibers were removed by filtration) at regular intervals over an extended period of time. The chlorine consumption of the liquor samples was determined both idometrically and calorimetrically.

The idiometric analysis was effected in the following manner: 50 ml of the fiber-free liquor sample 3 was reacted with 10 ml of a saturated chlorine solution, approximately 5 g/l $Cl_2$. After 5 minutes there was added an excess of potassium iodide, which had been acidified to pH 1. The iodine thus formed was titrated with sodium thiosulphate. Blanks were made in the same manner but with 50 ml distilled water instead of sample liquor.

The iodine values gave a precise determination of the amount of chlorine consumed by chemicals reactive therewith in the pulping liquors. These values were used to evaluate and calibrate the calorimetric determinations.

The calorimetric analysis was carried out as follows: The fibre-free liquor sample 3 of FIG. 1 in a continuous stream was mixed with a stream of saturated aqueous chlorine solution. The reaction mixture was then passed into a coil reactor, and the heat of reaction developed therein was measured as a potential in millivolts by a number of series-connected thermoelements. The potential obtained from the thermoelements provided a relationship with the iodometrically-determined chlorine consumption, which was linear over a wide range.

The relationship between the calorimetrically and titrimetrically determined analytic values is illustrated in FIGS. 2*a* and 2*b*, in which the calorimetric potentials are plotted on the Y-axis, and the corresponding iodometric chlorine-consumption values are plotted on the X-axis. FIG. 2*a* is for sulphate liquors, while FIG. 2*b* is for sulphite liquors. As will be seen from the Figures, the relationship is linear (correlation coefficient 0.995), and hence the calorimetric values can reliably be used for continuously determining the amount of chlorine consumed by the liquid. From the colorimetric value as determined in millivolts (mv) one can read off from the curves in FIGS. 2*a* and 2*b* the chlorine consumption in g/l $Cl_2$ for Sample 3 of FIG. 1.

In like manner, one can determine the amount of residual chlorine in the liquor after the bleaching. This tells how much total chlorine is consumed in the bleaching, and this total is the sum of chlorine consumed by the chemical (in the reaction of Example 1) and by the pulp. This is illustrated in Example 2.

EXAMPLE 2

Analysis of residual chlorine in the bleaching of cellulose pulp.

A larger number of fiber-free liquor samples were taken from the bleaching stage of a sulphite plant 15 minutes after the pu,p suspension and chlorine were mixed. The samples were analyzed calorimetrically and iodometrically. The iodometric titration was effected in a conventional manner, by reacting the sample with acidified potassium iodide solution. The liberated iodine was then titrated with sodium thiosulphate, whereafter the residual chlorine content was calculated.

In the calorimetric analysis of the chlorine content, a series of calibration solutions was prepared by adding 0.01, 0.05, 0.10, and 0.15 g/l $Cl_2$ to a liquor sample 9 according to FIG. 1, from which sample all chlorine had been stripped off. An exact determination of the chlorine content of these calibration solutions was obtained by iodometric titration. These values then served as one side of the curve of FIG. 3. In the calorimetric calibration, a stream of calibration solution was mixed with a stream of reagent solution comprising 0.2% potassium iodide with 0.2% sulphuric acid. The reaction heat developed therewith was measured to provide a potential by means of thermoelements. As the measurements were continued, the calibration solutions were replaced with a continuous stream of sample 9 according to FIG. 1. The two zones of values were used to plot the curve shown in FIG. 3, the calorimetric values plotted on the Y-axis, and the iodometric residual chlorine contents plotted on the X-axis. FIG. 3 thus shows the relationship between the calorimetric values, in millivolts, and the manually titrimetric values of the rsidual chlorine content, in g/l. As will be seen from the Figure, a practically linear relationship is obtained between the calorimetric values and the titrated values. Thus the amount of residual chlorine $Cl_2$ in g/l for sample 9 of FIG. 1 can be read off from the curve of FIG. 3 from the millivolt determination in the calorimetric analysis. All one need do is determine the mv value, and read the $Cl_2$ in g/l from the curve at that value.

From the curves of FIGS. 2*a*, 2*b* and 3, one can by calorimetric sample analysis determine chlorine consumed by the pulp by subtracting from the total amount of chlorine added at 6 in FIG. 1 the sum of the $Cl_2$ value read off FIG. 3 (from the mv value determined in the analysis of sample 9 of FIG. 1) and the $Cl_2$ value read off FIG. 2*a* or 2*b* (from the mv value determined in the analysis of the sample 3 from FIG. 1). This is utilized in Example 3 to control chlorine addition at 6 in FIG. 1.

EXAMPLE 3

Controlling the flow of chlorine to an introductory chlorine stage.

The tests were carried out on a suspension of unbleached pine sulphate pulp in pulping liquor, flowing to the introductory bleaching stage of a sulphate plant. The pulp was charged to the bleaching stage at a flow rate of 12,000 l/min, a pulp consistency of 2.5%, and a temperature of 20° C. The flow of chlorine to the introductory chlorine bleaching stage was controlled in the following manner.

As a control, the flow of chlorine to the stage was first controlled in accordance with the conventional set-point control process. Then, chlorine was charged to the introductory chlorinating bleaching stage in accordance with the method of the invention.

During the two runs, samples were taken manually in order to determine the Kappa number, the chlorine consumption, and the consistency of the influent pulp. The residual lignin content of the pulp was determined subsequent to the chlorination and alkaline extraction stages.

In the conventional set-point control method, using a redox potential measuring process, the set-point value with respect to the active chlorine content was held constant at 0.145 g/l, and the analytic measurements were taken after 75 seconds of reaction time between the chlorine and lignin.

In the method in accordance with the invention, the analytic measurements were taken after the same time interval, and the set-point value was adjusted manually every 5 minutes, with the guidance of the following empirical equation:

$$\text{SET-POINT VALUE (g active chlorine/l)} = 0.145[1+0.00300(F_{Cl_2} - 12 \times KF - 20.8]$$

in which KF is the chlorine consumption of the material in the incoming liquid (g/1) and $F_{Cl_2}$ is the relevant flow of chlorine (kg/min).

The results obtained are given in Table I below:

Table I

| | Control Conventional Set-Point Method | Method According to the invention |
|---|---|---|
| Consistency of pulp entering the bleaching stage, % | 2.50 ± 0.01 | 2.50 ± 0.01 |
| Kappa number, unbleached pulp | 33.2 ± 3.9 | 32.9 ± 4.0 |
| Chlorine consumption of suspending liquor entering the bleaching stage, g/l | 0.10 ± 0.12 | 0.20 ± 0.10 |
| Kappa number subsequent to chlorination and alkaline extraction | 6.15 ± 0.71 | 6.16 ± 0.10 |

As will be seen from the Table, the variations in Kappa number (=lignin content) of the pulp flowing to the introductory chlorinating stage were of approximately the same order of magnitude in both runs (±3.9 vs. ±4.0, respectively). In the method according to the invention, the amount of chlorine consumed by the suspending liquor passing to the bleaching stage was twice as large as that consumed in the conventional set-point method, which is representative of the variations which normally occur in pulp plants, and which can be attributed to the variations in washing efficiency.

As seen from the Table, the distribution range in Kappa number obtained with the conventional set-point control method was about 7 times greater than in the method according to the invention (±0.71 vs. ±0.10, respectively). When the amount of chlorine consumed varies to such an extent that it may be double that expected, the inadequacy of the control made possible by the conventional set-point control method becomes particularly marked, and as a result of the inadequate control, the variations in the lignin content of the chlorinated pulp are considerable. On the other hand, in the method according to the invention, the control is better, and as a result the Kappa number is relatively uniform, the variations in Kappa number being evened out.

EXAMPLE 4

Controlling the addition of chemicals in a sequential chlorine and chlorine dioxide bleaching stage.

Unbleached pine sulphate pulp suspension at a pulp consistency of 3% was flowed to a chlorine dioxide/-chlorine bleaching stage of a sulphate plant at a flow rate of 18,000 l/min.

The bleaching stage was a reaction stage with sequential addition of firstly chlorine dioxide, and secondly chlorine, without intermediate washing or alkaline extraction.

The flow of chlorine dioxide and chlorine to the introductory bleaching stage was controlled in the following manner.

During the first test period, chlorine dioxide was added to the pulp suspension in the first stage, and chlorine in the second stage, using conventional control methods.

During the second test period, chlorine dioxide and chlorine were added in respective stages using the control method of the invention.

During the tests, the influent pulp suspension was analyzed with respect to its consistency, Kappa number, and the chlorine consumption of the liquor in which the pulp was suspended.

Subsequent to the introductory chlorine dioxide/-chlorine stages, the pulp was extracted with alkali in a laboratory scale to remove lignin, prior to analyzing the lignin content of the pulp after the bleaching stage.

In the conventional control method, chlorine dioxide was added in the first stage in direct proportion to the production level, which during the test corresponded to an addition of 11.1 kg active chlorine/min. The chlorine was charged using a conventional set-point control method. The content of active chlorine was held constant at 0.130 g active chlorine/1, when measuring after 30 seconds reaction time.

In the control method according to the invention, chlorine dioxide was charged to the first stage in direct proportion to the production level, which corresponded to an addition of 11.1 kg active chlorine/min. The content of residual chlorine dioxide was determined as active chlorine after 10 seconds reaction time between chlorine dioxide and lignin. The chlorine charge was adjusted in accordance with the invention manually every 5 minutes, in accordance with the following empirical equation:

$$F_{Cl_2}=3.93(F_{ClO_2}-18\ C+18\ KF) \text{ where}$$

$F_{Cl_2}$ and $F_{ClO_2}$ represent the chlorine and chlorine dioxide flow, respectively, in kg active chlorine/minute, C is the residual chlorine-dioxide content determined as active chlorine after 10 seconds reaction time in grams per liter.

KF is the amount of bleaching chemicals used in the entering suspending liquor in grams of active chlorine per liter.

The method according to the invention was applied in conjunction with the measurement of the active chlorine requirement of the suspending liquor of the pulp suspension fed to a bleaching stage comprising two sequential bleaching stages. The analysis results from the first bleaching stage were used to control the addition of chemicals to the subsequent bleaching stage. Thus, the first bleaching stage was used as a lignin flow analyzer. The results obtained are shown in Table II below.

Table II

| | Control Conventional Set-Point Method | Method according to the invention |
|---|---|---|
| Consistency of pulp entering the bleaching stage, % | 3.05 ± 0.15 | 3.00 ± 0.16 |
| Kappa number unbleached pulp | 31.3 ± 3.4 | 32.1 ± 3.6 |
| Chlorine consumed in the suspending liquor entering the bleaching stage (g active chlorine/l) | 0.13 ± 0.08 | 0.16 ± 0.09 |
| Kappa number subsequent to chlorination and alkaline extraction | 5.90 ± 0.73 | 5.95 ± 0.14 |

As seen from the Table, the distribution range in the Kappa number obtained was ±0.73 in the conventional control method, and only ±0.14 in the method of the invention. The results show that in the method of the invention, the chlorine charge to the second bleaching stage can be according to the requirements adjusted, which is not possible in the conventional set-point control method, since it utilizes feed-back control, and the chemical charge is regulated by maintaining a constant residual chlorine content at the measuring position. If there is direct control of the chemical charge to the second bleaching stage, as in the method of the invention, the chemical supply can be utilized more effectively. In this way, the costs of chemicals can be reduced.

EXAMPLE 5

Controlling the alkali charge to an alkaline extraction stage in a bleaching sequence.

Unbleached pine sulphate at a pulp consistency of 3% was flowed at a rate of 18,000 l/min. to the introductory bleaching stage, a conventional chlorine stage, in which chlorine was added by the method in accordance with the invention as described in Example 3, but with corrections for the larger pulp flow. Subsequent to passing the chlorine stage, the pulp was washed, and extracted with aqueous alkali (NaOH) solution to remove lignin. The flow of aqueous alkali solution to the alkaline extraction stage following the introductory chlorine stage was experimentally controlled in accordance with a conventional method and in accordance with a feed-forward control method according to the invention, with the guidance of the amount of chlorine consumed by the substances dissolved in the incoming liquid, and the chlorine flow to the chlorine stage.

During a first test period, aqueous alkali solution was charged to the alkali stage in a conventional manner, according to pH values determined manually after the chlorine stage. The pH after this stage should exceed 10.5, if complete lignin dissolution is to take place. A higher pH means that excessive alkali has been charged. It was found necessary, however, to maintain the pH at an average of 11.0 after the extraction stage, in order to prevent the pH from falling below 10.5 at any time of said stage, because of the long residence time (60 minutes) in the extraction stage.

During a second test period, which was effected immediately after the first test period, aqueous alkali solution was charged to the alkali stage using the method according to the invention. The amount of chlorine consumed by substances dissolved in the liquor entering the bleaching stage was determined. Further, a set-point control was made in respect of the chlorine charge to the introductory chlorine stage. The value obtained when the chlorine flow was reduced with the product of the pulp flow and the consumption of chlorine by the incoming liquor was used to determined the lignin flow. The alkali flow to the subsequent alkali extraction stage was controlled by means of a feedforward control process, with the guidance of the following empirical equation:

$$F_{alkali}(t+60)=F_{Cl_2}(t)\cdot 0.429-KF(t)\cdot 5.04$$

in which $F_{alkali}(t+60)$ = the alkali flow in kg/min to the alkaline extraction stage with a time displacement of 60 min from the chlorine charge to the chlorine stage, $F_{Cl_2}(t)$ = the chlorine flow to the introductory chlorine stage in kg/min $KF(t)$ = the amount of bleaching chemical, chlorine, consumed by the entering suspending liquor in grams chlorine/l.

The test showed that in the method of the invention the alkali charge was more precise, so that the pH was held at an average of 10.7 during the whole of the test period, without the pH at any time falling below 10.5. The Example shows how the invention can be applied to provide a more exact alkali charge than was previously possible, thereby saving considerable quantities of alkali. When the average pH was lowered from 11.0 to 10.7, as obtained in accordance with the invention, an approximately 100% reduction in alkali consumption was obtained.

In the Examples given above, calorimetric measuring techniques have been used in the analyses made prior to and subsequent to or during the bleaching stage. It will be readily understood, however, that other measuring methods may also be used. One such method is the so-called chemiluminescence method, in which the bleaching chemicals in the suspending liquor are reacted with a reagent whilst emitting registerable light - this being a rapid and sensitive method which is particularly suitable for measuring low contents of active chlorine. Redox potential and polarographic measuring techniques can also be used, since they involve no reagent consumption.

The advantage afforded by the calorimetric measuring method, however, is that it is very accurate, as is evident from the curves in FIG. 2a and 2b, and in FIG. 3. Since the reaction heat is measured, this method affords the advantage that a large number of different bleaching agents can be used for analytical purposes, for example, such agents as chlorine, chlorine dioxide, hypochlorite, hydrogen peroxide and chlorite. The calorimetric measuring technique may also be used to advantage for determining alkali in those bleaching processes in which alkali, such as sodium hydroxide, is included as an active compound, e.g. alkaline oxygen-gas bleaching, and in alkali extraction processes. One advantage of this is that it is possible to use the same type of instrument for all of these substances.

Having regard to the foregoing disclosure, the following is claimed as the inventive and patentable embodiments thereof:

1. A process for controlling the addition of delignifying chemical for delignifying cellulose pulp suspended in an aqueous liquor containing spent chemical other than the cellulose pulp that is reactive with such delignifying chemical, which comprises determining firstly prior to the addition of delignifying chemical the amount of delignifying chemical consumed by the chemical reactive with the delignifying chemical in the liquor in the absence of the cellulose pulp; adding a known amount of the delignifying chemical to the cellulose pulp suspension, and then, during the delignification after a predetermined time interval following addition of the delignifying chemical to the cellulose pulp suspension, determining secondly in the absence of cellulose pulp fibers the residual amount of delignifying chemical in the liquor; from these first and second determinations and the known amount of delignifying chemical determining the amount of delignifying chemical consumed by the pulp; and then adding an amount of delignifying chemical adjusted according to the amount of delignifying chemical consumed by the pulp, and carrying out the delignification.

2. A process according to claim 1 in which each determination is made on samples of the suspending liquor.

3. A process according to claim 2 in which a sample of the suspending liquor is taken within a few seconds after addition of the delignifying chemical thereto, for the determination of the amount of delignifying chemical consumed by the chemical and cellulose pulp.

4. A process according to claim 2 in which a sample of the suspending liquor is taken a predetermined time interval within the range from a few seconds to about 10 hours after the delignifying chemical has been added to the liquor.

5. A process according to claim 4 in which the time interval is within the range from about 30 seconds to about 10 hours.

6. A process according to claim 2 in which a sample of the suspending liquor is taken at the conclusion of a delignification stage.

7. A process according to claim 1 in which the results of the determination are used to adjust the amount of delignifying chemical in the delignification stage in which the first and second determinations are made.

8. A process according to claim 1 in which the results of the determination are used to adjust the amount of delignifying chemical in any of the subsequent delignification stages following the stage in which the first and second determinations are made.

9. A process according to claim 1, in which at least one delignifying chemical is added to the pulp, and permitted to react therewith.

10. A process according to claim 1, in which an aqueous alkali is added to the pulp, to dissolve lignin from the pulp.

11. A process according to claim 1, in which the cellulose pulp is a chemical pulp from wood which has been digested by means of a chemical process selected from the group consisting of sulphite, sulphate, oxygen gas-alkali, bisulphite and soda cooking processes.

12. A process according to claim 11, in which the chemical pulp has a lignin content corresponding to a Kappa number within the range from about 100 to about 5.

13. A process according to claim 1, in which the cellulose pulp is selected from the group consisting of semichemical, mechanical, and thermomechanical pulps.

14. A process according to claim 1, in which the delignifying chemical is chlorine.

15. A process according to claim 1, in which the delignifying chemical is chlorine dioxide.

16. A process according to claim 1, in which the delignifying chemical is a mixture of chlorine and chlorine dioxide.

17. A process according to claim 16, in which chlorine and chlorine dioxide are added in a sequential manner in either order.

18. A process according to claim 1, in which the determination of the amount of delignifying chemical consumed is made calorimetrically.

19. A process for controlling the addition of bleaching chemical for bleaching cellulose pulp suspended in an aqueous liquor containing spent chemical other than the cellulose pulp that is reactive with such bleaching chemical, which comprises determining firstly prior to the addition of the delignifying chemical the amount of bleaching chemical consumed by the chemical reactive with the bleaching chemical in the liquor in the absence of the cellulose pulp; adding a known amount of bleaching chemical to the cellulose pulp suspension; and then, during the delignification after a predetermined time interval following addition of the bleaching chemical to the cellulose pulp suspension, determining secondly in the absence of cellulose pulp fibers the residual amount of bleaching chemical in the liquor; from these first and second determinations and the known amount of bleaching chemical determining the amount of bleaching chemical consumed by the pulp; and then adding an amount of bleaching chemical adjusted according to the amount of bleaching chemical consumed by the pulp, and carrying out the bleaching.

20. A process according to claim 19 in which each determination is made on samples of the suspending liquor.

21. A process according to claim 20 in which a sample of the suspending liquor is taken within a few seconds after addition of the bleaching chemical thereto, for the determination of the amount of bleaching chemical consumed by the chemical and cellulose pulp.

22. A process according to claim 20 in which a sample of the suspending liquor is taken a predetermined time interval within the range from a few seconds to about 10 hours after the bleaching chemical has been added to the liquor.

23. A process according to claim 19 in which the results of the determination are used to adjust the amount of bleaching chemical in the bleaching stage in which the first and second determinations are made.

24. A process according to claim 19 in which the results of the determination are used to adjust the amount of bleaching chemical in any of the subsequent bleaching stages following the stage in which the first and second determinations are made.

25. A process according to claim 19 in which at least one bleaching chemical is added to the pulp, and permitted to react therewith.

26. A process according to claim 19 in which an aqueous alkali is added to the pulp, to dissolve lignin from the pulp.

27. A process according to claim 19 in which the cellulose pulp is a chemical pulp from wood which has been digested by means of a chemical process selected from the group consisting of sulphite, sulphate, oxygen gas-alkali, bisulphite and soda cooking processes.

28. A process according to claim 27 in which the chemical pulp has a lignin content corresponding to a Kappa number within the range from about 100 to about 5.

29. A process according to claim 19 in which the cellulose pulp is selected from the group consisting of semichemical, mechanical, and thermomechanical pulps.

30. A process according to claim 19, in which the bleaching chemical is chlorine.

31. A process according to claim 19 in which the bleaching chemical is chlorine dioxide.

32. A process according to claim 19 in which the bleaching chemical is a mixture of chlorine and chlorine dioxide.

33. A process according to claim 32 in which chlorine and chlorine dioxide are added in a sequential manner, in either order.

34. A process according to claim 19 in which the determination of the amount of bleaching chemical consumed is made calorimetrically.

* * * * *